US008800546B2

(12) United States Patent
Fowler et al.

(10) Patent No.: US 8,800,546 B2
(45) Date of Patent: Aug. 12, 2014

(54) FIREPLACE SCREEN

(75) Inventors: Brian Fowler, Christiana, TN (US); Paul Dusky, Greenbrier, TN (US)

(73) Assignee: Innovative Hearth Products, LLC., Nashville, TN (US)

( * ) Notice: Subject to any disclaimer, the term of this patent is extended or adjusted under 35 U.S.C. 154(b) by 855 days.

(21) Appl. No.: 12/955,006

(22) Filed: Nov. 29, 2010

(65) Prior Publication Data

US 2012/0132192 A1 May 31, 2012

(51) Int. Cl.
*F24B 1/192* (2006.01)

(52) U.S. Cl.
USPC ..... 126/548; 126/544

(58) Field of Classification Search
USPC ..... 126/548, 544; 160/352, 88
See application file for complete search history.

(56) References Cited

U.S. PATENT DOCUMENTS

2009/0183693 A1* 7/2009 Furman ..... 122/16.1

FOREIGN PATENT DOCUMENTS

CA 2262222 * 8/2000

* cited by examiner

*Primary Examiner* — Alfred Basichas

(57) ABSTRACT

A fireplace screen comprising a mesh structure positionable about an outer surface of a fireplace opening. The mesh structure is shaped to cover the fireplace opening. Holes in the mesh structure are configured to promote an inflow of air external to a fireplace through the mesh structure and a vertical circulation of the air across an interior planar surface of the mesh structure located outside of the fireplace opening.

20 Claims, 4 Drawing Sheets

FIREPLACE SCREEN

TECHNICAL FIELD

This application is directed, in general, to fireplace screens, fireplaces, and methods of manufacturing thereof.

BACKGROUND

Fireplace screens have been used to prevent embers of burning wood from being discharged from the fireplace into a room, or, to reduce the risk of a person from directly touching the fire or other hot objects. In some cases, a glass panel enclosure can be installed to cover the fireplace opening.

SUMMARY

One embodiment of the present disclosure is a fireplace screen. The fireplace screen comprises a mesh structure positionable about an outer surface of a fireplace opening. The mesh structure is shaped to cover the fireplace opening. Holes in the mesh structure are configured to promote an inflow of air external to a fireplace through the mesh structure and a vertical circulation of the air across an interior planar surface of the mesh structure located outside of the fireplace opening.

Another embodiment of the present disclosure is a fireplace. The fireplace comprises a fireplace housing having a base. The fireplace also comprises a flame element located on the base and viewable through an opening in the fireplace housing. The fireplace opening also comprises a fireplace screen. The fireplace includes a mesh structure, wherein the mesh structure is shaped to cover the opening. Holes in the mesh are configured to promote the inflow of air external to the fireplace housing through the mesh and a vertical circulation of the air across an interior planar surface of the mesh located outside of the fireplace opening.

Another embodiment of the present disclosure is a method of manufacturing a fireplace screen. The method includes forming a mesh structure. The mesh structure is shaped to cover a fireplace opening and holes in the mesh are configured to promote the inflow of air external to a fireplace through the mesh and a vertical circulation of the air across an interior planar surface of the mesh located outside of the fireplace opening.

BRIEF DESCRIPTION OF THE DRAWINGS

Reference is now made to the following descriptions taken in conjunction with the accompanying drawings, in which.

DETAILED DESCRIPTION

Embodiments of the present disclosure mitigate the risk of burn injury from the heating of fireplace screens or glass panel enclosures covering a fireplace opening. The fireplace screen of the present disclosure is designed so as to dissipate heat such that the exterior surface of the screen remains within acceptable thermal mass or heat transfer efficiency, when a fireplace to which it is attached is generating heat. For instance, the acceptable thermal mass or heat transfer efficiency would be low enough that incidental transfer of heat energy to human skin contact remains below an acceptable limit.

Figure 1A:
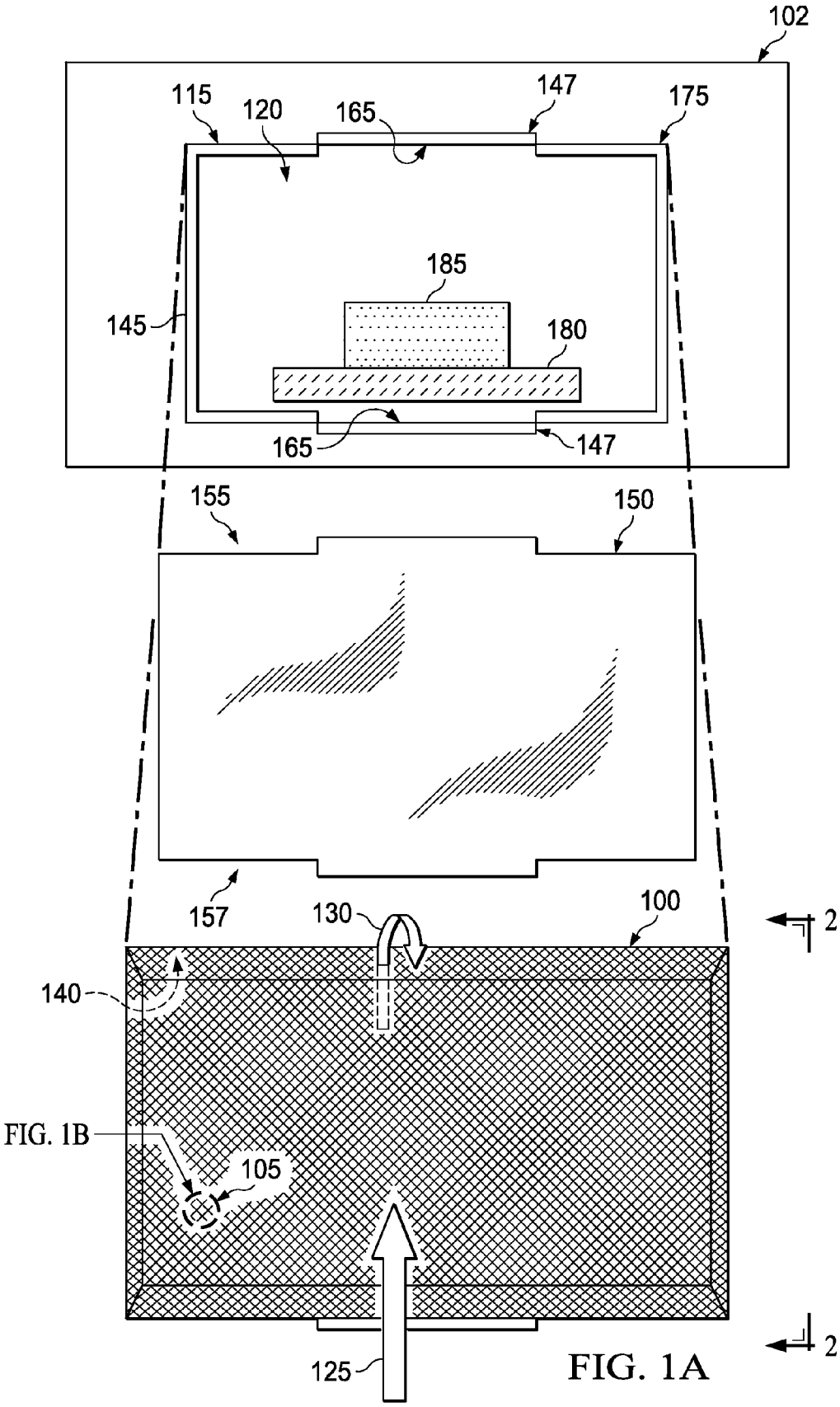
FIG. 1A presents an exploded schematic front view of an example embodiment of a fireplace screen and fireplace of the disclosure.
Figure 1B:
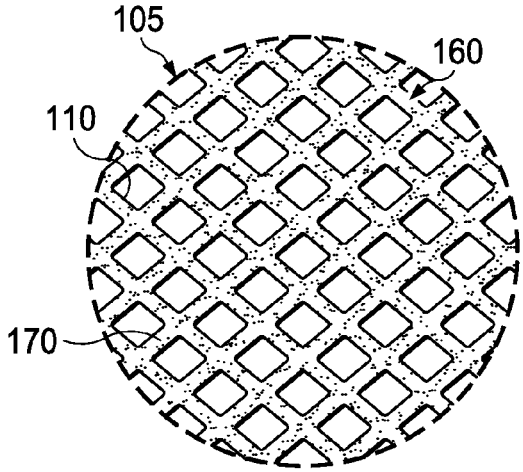
FIG. 1B presents a detail view of the mesh structure of an example embodiment of a fireplace screen and fireplace of the disclosure, such as the screen depicted in FIG. 1A.
Figure 2:
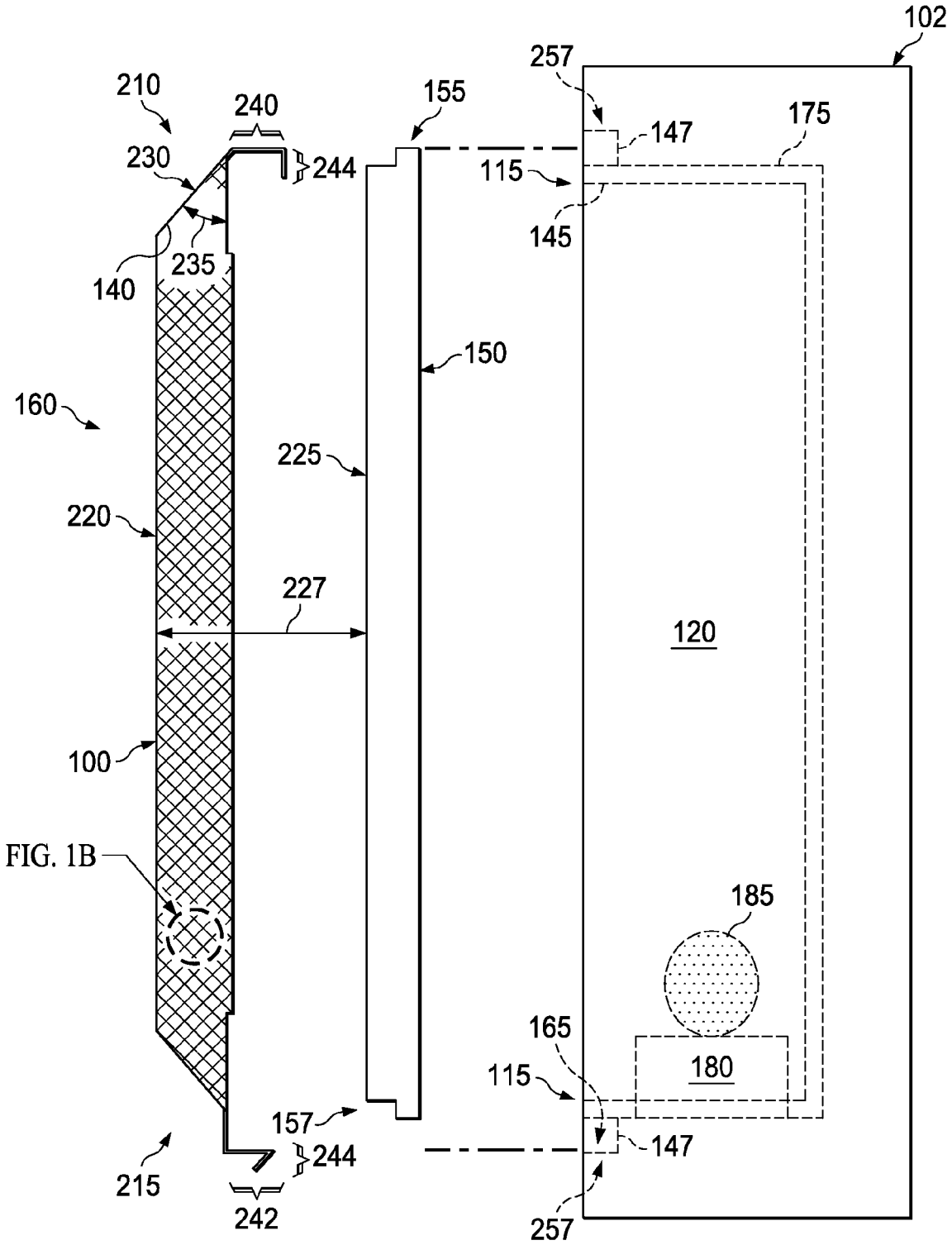
FIG. 2 presents an exploded side view of the fireplace screen and fireplace presented in FIG. 1A, along view line 2 as depicted in FIG. 1.

One embodiment of the present disclosure is a fireplace screen. FIG. 1A presents an exploded schematic front view of an example embodiment of a fireplace screen 100 and fireplace 102 of the disclosure. FIG. 1B presents a detail view of a mesh structure 105 of an example embodiment of a fireplace screen of the disclosure, such as the screen 100 depicted in FIG. 1A. FIG. 2 presents an exploded side view of the fireplace screen 100 and fireplace 102 along view line 2 as depicted in FIG. 1A.

With continuing reference to FIGS. 1A and 1B, the screen 100 comprises a mesh structure 105 having through-holes 110 therein. The mesh structure 105 is positionable about an outer surface 115 of a fireplace opening 120. The mesh structure 105 is shaped to cover the opening 120. That is, when the screen 100 is attached, no solid object can access the fireplace opening 120 other than through the holes 110 in the mesh structure 105. The holes 120 in the mesh structure 105 are configured to promote (e.g., when the fireplace is generating heat) an inflow of air 125 external to a fireplace 102 through the mesh structure 105 and also to promote a vertical circulation of the air 130 across an interior planar surface 140 of the mesh structure 105 that is located outside of the fireplace opening 120.

The term mesh structure as used herein refers to a semi-permeable barrier composed of an inflammable material such as a metal, ceramic or similar material. The term mesh structure includes solid structures having perforations to form the holes therein, as well as strands of metal, ceramic fiber, or similar material that are weaved or otherwise interconnected to form the holes therein. In some cases, the mesh structure includes or is composed of a flexible or ductile material such as steel. In some cases, the mesh structure includes or is composed of an inflexible material such as a ceramic.

In some embodiments of the screen 100, the mesh structure 105 is attached to a frame 145 that defines the outer surface 115 of the fireplace opening 120. The term outer surface 115 as used herein could include other integral features of the fireplace 102 that are suitable or adaptable for attaching the mesh structure 105 thereto. In some embodiments, the fireplace opening 120 is covered by a transparent panel 150. The transparent panel 150 can be attached to same or different attachment points 147 of the frame 145 or other features of the fireplace 102 that the mesh structure 105 is attached to. In some cases, the mesh structure 105 can be attached to one or more edges 155, 157 of the transparent panel 150, e.g. a glass panel, thereby locating the mesh structure 105 outside of the fireplace opening 120.

As further depicted in FIG. 2, in some embodiments of the screen 100, one or more ends 210, 215 of the mesh structure 105 are bent such that a central planar surface 220 of the mesh structure 105 is offset from a parallel planar surface 225 of the transparent panel 150 when the mesh structure 105 is attached to the transparent panel 150 or to the frame 145. In some cases, to ensure a desired level of vertically circulating air 130, a distance 227 of the offset between the central planar surface 220 of the mesh structure 105 and the parallel planar surface 225 of the transparent panel 150 is at least about ⅛ of an inch, and in some preferred embodiments, the distance 227 is a value in a range between about 1.5 and 9 inches. In some embodiments, the mesh structure 105 is attached to the transparent panel 150 (or to the frame 145) such that a pull force or a push force of up to about 5 pounds does not dislodge the mesh structure from its attachment points 147. In some embodiments, the mesh structure 105 is not dislodged by a pull or push force up to about 50 pounds. In some embodiments, the pull or push force (e.g., of up to 5, or, in some cases up to 50 pounds) can be applied in any direction without dislodging the mesh structure 105. In some cases, the mesh structure 105 is attached and to the transparent panel 150 (or to the frame 145), and has a limited ductility or flexibility, such that other than its attachment points 147, a pull force or a push force of at least 5 pounds, and in some cases up to 50 pounds, does not cause the mesh structure 105 to contact any other structures of the fireplace 102, including structures that are heated during the fireplace's operation.

As also depicted in FIG. 2, in some embodiments of the screen 100, one or more of the bent ends 210, 215 of the mesh structure 105 forms the interior surface 140 as a beveled interior surface that has an incident (i.e., non-perpendicular) angle to the planar surface 225 of the transparent panel 150, or outer surface 115. For instance, in some cases, an interior angle 235 between the interior planar beveled surface 140 and the planar surface 225 is in a range of about 15 to 80 degrees, and in some preferred embodiments, about 40 degrees. In addition to preventing a top outer surface 230 from serving as a ledge upon which objects could be placed (and thereby becoming a burn hazard when the object heats up), beveling the surface 140 can further promote the flow of vertically circulating air 130 thereby enhancing cooling of the screen 100.

As additionally depicted in FIG. 2, in some cases, a bend 240 in the top end 210 of the mesh structure 105 forms a hook that is configured to fit over an upper edge 155 of the transparent panel so that the mesh structure 105 hangs on the transparent panel. In some cases a bend 242 in the bottom end 215 of the mesh structure 105 forms a clasp that is configured to fit over a bottom edge 157 of the transparent panel 150. In some preferred embodiments, the bends 240, 242 facilitate the tool-less removal of the mesh structure 105 to the transparent panel 150, frame 145, or other features of the outer surface 115.

In the some cases, in addition, or as an alternative to the above described upper and lower bends 240, 242 there can be a bend 244 in the top or bottom end 210, 215 of the mesh 105 that forms a flange that fits into one or more openings 165 located in an edge (e.g., upper or lower edge 255, 257) of the fireplace frame 145 defining the fireplace opening 120. In some embodiments, the bends 244 that form flanges may fit into the same openings 165 that flanges on the edges 155, 157 of the panel 150 fit into, to thereby cover the opening 120.

Based on the present disclosure, one skilled in the art would appreciate that a variety of bends or other mechanical method could be used to facilitate the attachment of the mesh structure 105 to the transparent panel 150, the frame 145 or other features of the outer surface 115.

In some preferred embodiments of the screen 100, the holes 110 are distributed over the entire surface 160 of the mesh 105. In some cases, the holes 110 can be distributed uniformly over the mesh 105. In other cases, to further promote the desired air flow 125, 130 there can be more holes 110 in certain areas of the surface 160 (e.g., the interior planar surface 140, or the lower ⅓ of the central planar surface 220.

The amount of openness of the screen 100 is a balance between promoting the desired air flow 125, 130 and providing the screen 100 with which sufficient mechanical strength to withstand incidental contact without being plastically deformed or other wise detrimentally distorted in shape. In some embodiments of the screen 100, the holes 110 in the mesh 105 occupy about 30 percent to 80 percent of a total surface area of the mesh 105. In some preferred embodiments, the holes 110 in the mesh 105 occupy about 50 to 70 percent of a total surface area of the mesh 105.

The holes 110 can have circular, triangular, square, rectangular or other regular shapes or irregular shapes. In some cases, to simplify the manufacturing process, all of the holes 110 can have the same shape, while in other cases, to further promote the desired air flow 125, 130, there can be differently shaped holes 110 in different regions of the surface 160.

The size of the holes 110 reflects a balance of being large enough to promote the desired air flow 125, 130 but not too large as to permit common household objects, or human digits, to be passed through the holes 110. In some example embodiments, such as when the holes 110 are circular the diameter of the holes is in a range from 3/16 to 3/8 inches. In some example embodiments, the area of the individual holes 110 is in a range from 0.04 to 0.08 square inches. In some cases, to simplify the manufacturing process, all of the holes 110 can have the same size, while in other cases, to further promote the desired air flow 125, 130, there can be differently sized holes 110 in different regions of the surface 160.

In embodiments of the screen 100, the mesh structure 105 is coated with a thermally insulating material 170. The insulating material contributes to limiting the heat transfer capacity below an acceptable level when the fireplace 102 is in operation. In some cases, the thermally insulating material 170 can coat the entire surface 160 of the mesh 105, while in other cases only the outside surface 160 (i.e., the surface that would be outside of the opening 120 when attached to the outer surface 115 or to the panel 150) are coated. Some embodiments of the insulating material 170 are chemically resistant to common household cleaning solvents, such as ammonia-containing or alcohol-containing cleaning solvents. Some embodiments of the insulating material 170 are composed of urethane-based powder coat.

Some embodiments of the screen 100 include a frameless unitary body of the mesh structure 105. Avoiding the use of a frame can be beneficial because a frame can deter the desired air flow 130, or, could create a hot spot on the exterior of the screen 100. For instance, a frame itself can become a hot-spot. Nevertheless, other embodiments of the screen 100 can include a frame around the mesh structure 105.

FIG. 1A illustrates another embodiment of the disclosure: a fireplace 102. The fireplace 102 comprises a housing 175 having a base 180 and an opening 120. The fireplace 102 further comprises a flame element 185 (e.g., a gas or propane fueled burner, or, wood or other combustible material). The flame element 185 is located on the base 180 and viewable through the opening 120. The fireplace 102 also comprises a fireplace screen 100. The fireplace screen 100 can include any of the embodiments of screens described above in the context of FIGS. 1A-2. For instance, the screen 100 includes a mesh structure 105 shaped to cover the opening 120, and holes 110 in the mesh 105 are configured to promote the inflow of air 125 external to the fireplace housing 175 through the mesh 105 and a vertical circulation of the air 130 across an interior planar surface 140 of the mesh 105 that is located outside of the fireplace opening 120.

Some embodiments of the fireplace 102 include a transparent panel 150 to which the screen 100 can be attached, as discussed above.

In some embodiments of the fireplace 102, the screen's 102 shape, holes 110, and sometimes the insulating coating 170, facilitate the entire outer surface 160 of the mesh 105 being below a heat transfer capability limit when the flame element 185 is generating heat. For instance, the limit can be indicated by the target temperature from a thermesthesiometer evaluation according to an ASTM standard, or other compliance temperature evaluation protocol. For instance, in some cases the target temperature of a thermesthesiometer reading is equal to or less than 60° C.

Figure 3:
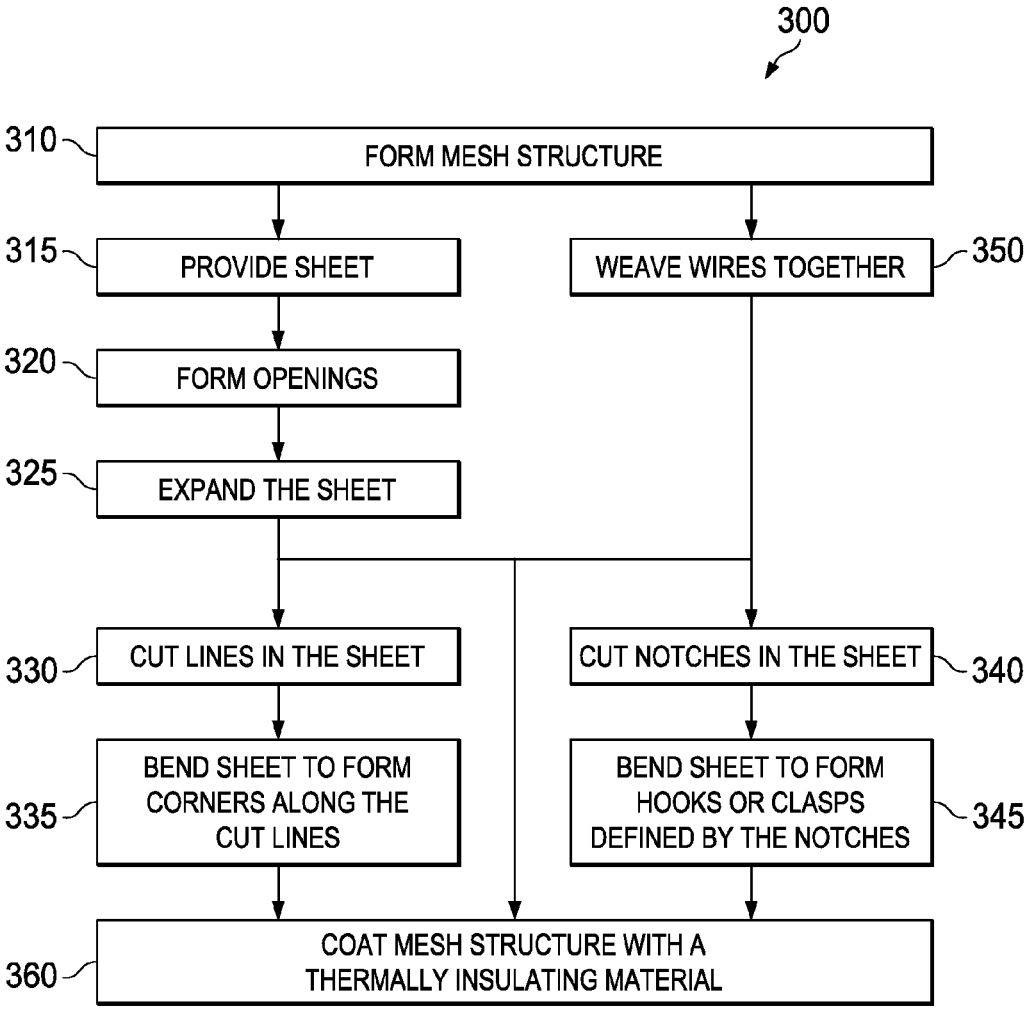
FIG. 3 presents a flow diagram of an example method of manufacturing a fireplace screen, such as any of the screens depicted in FIGS. 1A-2.

Another embodiment of the present disclosure is a method of manufacturing a fireplace screen. FIG. 3 presents a flow diagram of an example method 300 manufacture, such as methods of manufacturing any of the screens 100 depicted in FIGS. 1A-2.

With continuing reference to FIGS. 1 and 2 throughout, the example method 300 depicted in FIG. 3 comprises a step 310 of forming a mesh structure 105. The mesh structure 105 is shaped to cover a fireplace opening 120 and holes 110 in the mesh 105 are configured to promote the inflow of air 125 external to a fireplace 102 through the mesh 105 and a vertical circulation of the air 130 across an interior planar surface 140 of the mesh 105 located outside of the fireplace opening 120.

In some embodiments forming the mesh structure in step 310 includes a step 315 of providing a sheet (e.g., a unitary metal sheet, such as a steel sheet in some cases), a step 320 of forming openings in the sheet, and a step 325 of expanding the metal sheet so as to increase a surface area of the metal sheet. As part of the step 325 to expand the sheet, the openings in the sheet can be expanded to form the holes 110 of mesh 105.

In some embodiments, forming the mesh structure 105 (step 310) further includes a step 330 of forming lines in a metal sheet (in some cases, e.g., the expanded sheet produced in step 325), and, a step 335 of bending the sheet so as to form corners along the formed lines and a central planar surface (e.g., surface 220) that is offset from bent ends of the expanded sheet. Forming the lines in step 330 can include cutting, stamping, molding or any number conventional process well known to one skilled in the art.

Figure 4:
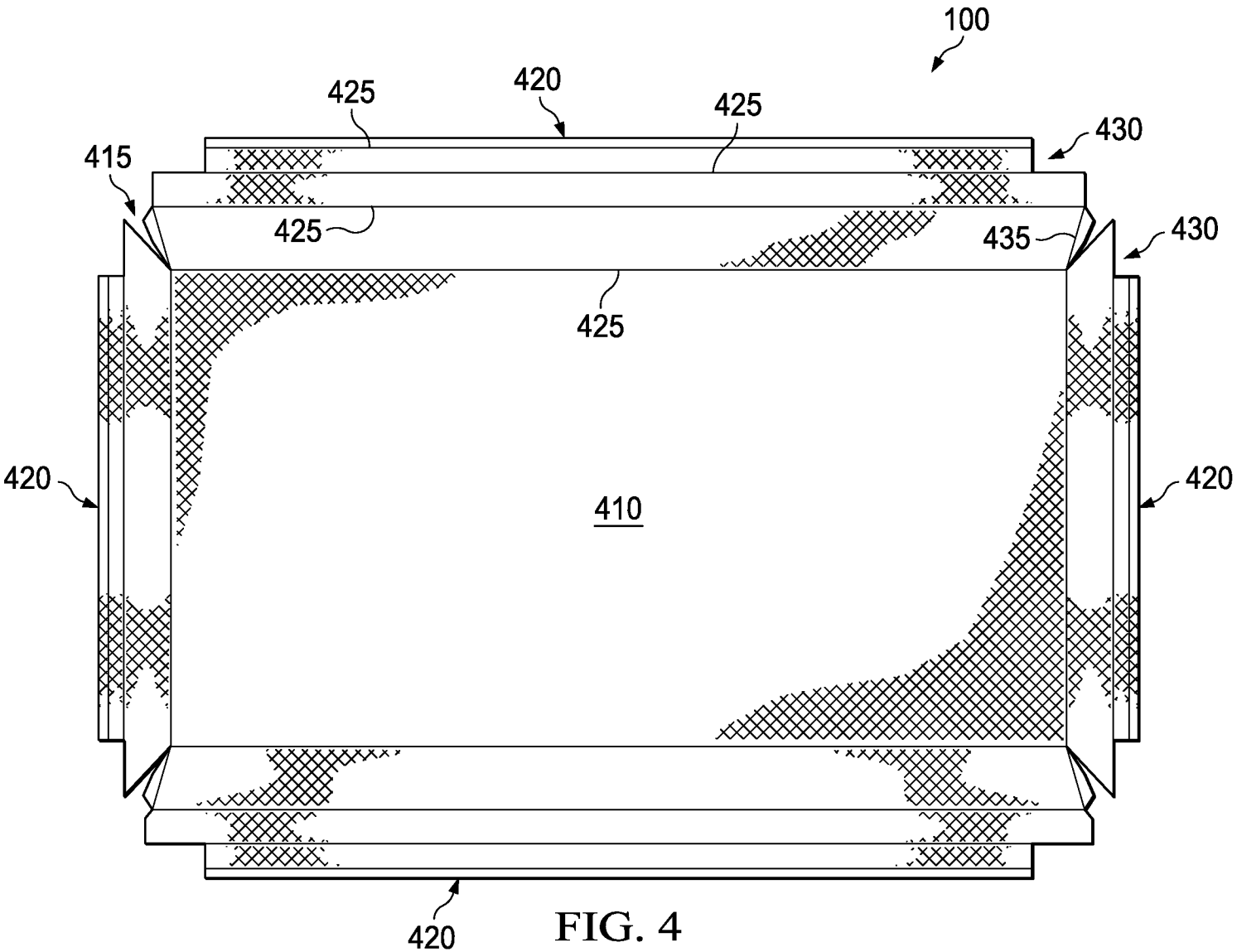
FIG. 4 presents a plan view of an example fireplace screen at an intermediate stage of manufacture such as presented in the example method depicted in FIG. 3.

Certain aspects of steps 330 and 335 are presented in FIG. 4, which shows a plan view of an example fireplace screen 100 at an intermediate stage of manufacture. FIG. 4 presents a plan view of an example sheet 410 after forming lines 415 in accordance with step 330, but before bending the sheet 410 in accordance with step 335. Bending ends 420 of the sheet 410 along bend lines 425 in step 335 can produce corners along the formed lines 415. One skilled in the art would understand how the corners could then be secured via welding, or mechanical latching, or other bonding means.

In some embodiments, forming the mesh structure 105 (step 310) further includes a step 340 of forming notches in a sheet (in some cases, e.g., the expanded metal sheet such as produced in step 325) and a step 345 of bending ends of the sheet along bend lines defined by the notches so as to form hooks configured to fit over an edge 155, 157 of a transparent panel 150 that is configured to cover the fireplace opening 120. Any number of conventional processes well known to one skilled in the art, such as cutting, stamping, molding could be used to form the notches in step 340.

Aspects of steps 340 and 345 are also presented in FIG. 4. The sheet 410 is depicted after forming notches 430, e.g., by cutting or stamping away portions of the sheet 410. The ends 420 of the sheet 410 can be bent along bend lines 435 that are defined by the notches 430 so as to form hooks. Steps 340 and 345 could be similarly used to form clasps, flanges or other structures in the ends 240, 242 of the mesh 105 to facilitate the mesh's 105 attachment to the panel 150 or to the frame 145 of the fireplace 102.

In other embodiments, forming the mesh structure in step 310 can include a step 350 of weaving two or more metal (or ceramic, or other material) wires together so as to form a planar lattice sheet (e.g., a planar metal lattice sheet in some cases) with the holes 110 therein. The planar lattice sheet could then be cut and bent such as described in steps 330-345 to form the mesh structure 105.

The some embodiments of the method 300 of forming the screen 100 can further include a step 360 of coating the mesh 105 with a thermally insulating material. For example the mesh structure 105 can be formed in accordance with one or more of steps 330-350 and then powder coated with a urethane based insulating material, using procedures well known to those skilled in the art.

Those skilled in the art to which this application relates will appreciate that other and further additions, deletions, substitutions and modifications may be made to the described embodiments.

What is claimed is:

1. A fireplace screen, comprising:

a mesh structure positionable about an outer surface of a fireplace opening, wherein the mesh structure is shaped to cover the fireplace opening, and, holes in the mesh structure are configured to promote an inflow of air external to a fireplace through the mesh structure and a vertical circulation of the air across an interior planar surface of the mesh structure located outside of the fireplace opening and wherein a total number of openings per unit area of a central planar surface of the mesh structure is different for different regions of the central planar surface.

2. The screen of claim 1, wherein the mesh structure is attached to a frame defining the outer surface of the fireplace opening.

3. The screen of claim 1, wherein the fireplace opening is covered by a transparent panel and the mesh structure is attached to one or more edges of the transparent panel so as to locate the mesh structure outside of the fireplace opening.

4. The screen of claim 3, wherein one or more ends of the mesh structure are bent such that a central planar surface of the mesh structure is offset from a parallel planar surface of the transparent panel when the mesh structure is attached to the transparent panel.

5. The screen of claim 4, wherein a distance of the offset is at least about ⅛ of an inch.

6. The screen of claim 4, wherein the mesh structure is attached to the transparent panel such that a pull force or a push force of up to 5 pounds not dislodge the mesh structure from its attachment points.

7. The screen of claim 3, wherein one or more bent ends of the mesh structure forms the interior surface as a beveled surface that has an incident angle to the planar surface of the transparent panel.

8. The screen of claim 3, wherein a bend in a top end of the mesh structure forms a hook that is configured to fit over an upper edge of the transparent panel so that the mesh structure hangs on the transparent panel and a bend in a bottom end of the mesh structure forms a clasp that is configured to fit over a lower edge of the transparent panel.

9. The screen of claim 4, wherein a bend in a top end or bottom end of the mesh structure forms a flange that is configured to fit into one or more notches located in an edge of a frame of the fireplace opening.

10. The screen of claim 1, wherein the holes in the mesh are distributed over the entire surface of the mesh structure.

11. The screen of claim 1, wherein the holes in the mesh structure occupy about 30 percent to about 80 percent of a total surface area of the mesh structure.

12. The screen of claim 1, wherein the holes in the mesh structure occupy an area in a range of about 50 to 70 percent of an total surface area of the mesh structure.

13. The screen of claim 1, wherein the mesh structure is coated with a urethane-based thermally insulating material.

14. The screen of claim 1, wherein the screen is a frameless unitary body of the mesh structure.

15. A fireplace, comprising:

a fireplace housing having a base;

a flame element located on the base and viewable through an opening of the fireplace housing; and a fireplace screen that includes a mesh structure, wherein the mesh structure is shaped to cover the opening, and holes in the mesh are configured to promote the inflow of air external to the fireplace housing through the mesh, and a vertical circulation of the air across an interior planar surface of the mesh located outside of the fireplace opening and wherein a total number of openings per unit area of a central planar surface of the mesh structure is different for different regions of the central planar surface.

16. The fireplace of claim 15, wherein an entire outer surface of the mesh structure is at or below a target thermesthesiometer reading equal to or less than 60° C. when the flame element is generating heat.

17. The screen of claim 1, wherein the total number of openings per unit area in a lower one-third of the central planar surface is greater than the total number of openings per unit area in a upper two thirds of the central planar surface.

18. The screen of claim 1, wherein a top outer surface of the mesh is beveled relative to the central planar surface of the mesh structure.

19. The fireplace of claim 13, wherein the total number of openings per unit area in a lower one-third of the central planar surface is greater than the total number of openings per unit area in a upper two thirds of the central planar surface.

20. The fireplace of claim 13, wherein a top outer surface of the mesh is beveled relative to the central planar surface of the mesh structure.

* * * * *